US006295029B1

(12) United States Patent
Chen et al.

(10) Patent No.: US 6,295,029 B1
(45) Date of Patent: Sep. 25, 2001

(54) MINIATURE MICROSTRIP ANTENNA

(75) Inventors: I-Fong Chen, Tao-Yuan Hsien; Meng-Luen Lee, Changhwa Hsien, both of (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 09/670,533

(22) Filed: Sep. 27, 2000

(51) Int. Cl.[7] ..... H01Q 1/38
(52) U.S. Cl. ..... 343/700 MS; 343/895
(58) Field of Search ..... 343/700 MS, 702, 343/846, 848, 895

(56) References Cited

U.S. PATENT DOCUMENTS 5,712,647 * 1/1998 Shively ..... 343/895
5,936,583 * 8/1999 Sekine et al. ..... 343/702
6,204,826 * 3/2001 Rutkowski et al. ..... 343/895

* cited by examiner

*Primary Examiner*—Tan Ho
(74) *Attorney, Agent, or Firm*—Dougherty & Troxell

(57) ABSTRACT

A miniature microstrip antenna having a circuit board with a suitable length and a suitable width, and especially a microstrip antenna of which the size is reduced but the antenna still keeps the broadband function in all the directions, wherein, the circuit board does not have any metallic portion in the back side thereof. A ¼λ microstrip line is rolled on the surface of the circuit board in the shape of a rectangular spiral, the end of the rectangular spiral microstrip line is connected via a vertical section to another ½₀λ microstrip line which acts as an open-stub. A junction of the rectangular spiral microstrip line with the open-stub acts as a signal feeder point; a ground plane is provided near the signal feeder point but does not connect with the signal feeder point, the ground plane is punched to form a hole to get a desired harmonic oscillation frequency shifting. The miniature microstrip antenna has the size thereof reduced can thus be obtained.

2 Claims, 3 Drawing Sheets

MINIATURE MICROSTRIP ANTENNA

BACKGROUND OF THE INVENTION

1. Field of the Invention

The present invention is related to a miniature microstrip antenna, and especially to a microstrip antenna of which the size is reduced but the antenna still keeps the broadband function in all the directions.

2. Description of the Prior Art

Coil antennae with spiral structures are widely used in various communication instruments; the most common ones are mobile phones. Basically, such coil antennae are exposed. In the recent years however, notebook style computers with communication function adopt built-in microstrip antennae.

Earlier microstrip antennae, such as those disclosed in the U.S. Pat. Nos. 3,921,177 and 3,810,183, are normally made from round or rectangular thin metallic sheets, they are separated from ground sheets with filled-in dielectric material, such microstrip antennae generally only suit narrower bandwidths. U.S. application Ser. No. 07/695686 , now abandoned, provides a polygonal spiral microstrip antenna having improvement on the earlier microstrip antennae, the bandwidth thereof approaches a normal antenna with a predetermined impedance. However, such a spiral microstrip antenna has the defect that, when in the condition of low frequency, the diameter of the antenna will be quite enlarged such that it will not suit modern communication instruments carried on one's own.

To this, Taiwan patent No. 81108896 (U.S. application Ser. No. 07/798700), now abandoned, provides a reduced and broadband microstrip antenna, but a spiral antenna element is provided on a separated ground sheet, and a kind of dielectric material and load of predetermined thickness are interposed therebetween, so that size of the whole antenna can hardly be further reduced.

SUMMARY OF THE INVENTION

The object of the present invention is to provide a miniature microstrip antenna of which the size can be further reduced but the antenna still keeps the broadband function in all the directions.

To get the above stated object, the present invention has a ¼λ microstrip line rolled on the surface of a circuit board in the shape of a rectangular spiral, the end of the rectangular spiral microstrip line is connected vertically to a 1/20λ microstrip line as an open-stub, the junction of the rectangular spiral microstrip antenna with the open-stub acts as a signal feeder point. A ground plane being also provided on the surface of the circuit board is located beside the signal feeder point but is not connected with the signal feeder point. The ground plane can also make a harmonic oscillation frequency shifting by punching holes to form a miniature microstrip antenna which keeps the broadband effect in all the directions.

The present invention will be apparent in its novelty and other characteristics after reading the detailed description of the preferred embodiment thereof in reference to the accompanying drawings. Wherein:

DETAILED DESCRIPTION OF THE PREFERRED EMBODIMENT

Figure 1:
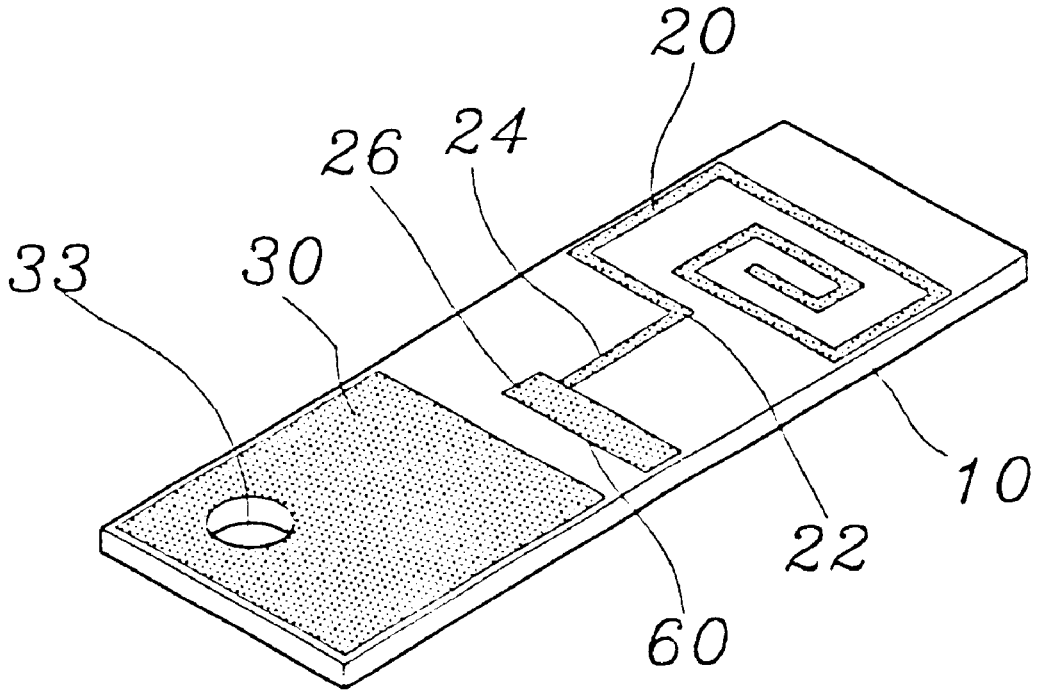
FIG. 1 is a perspective view of a preferred embodiment of the present invention.

Referring to FIG. 1, the present invention generally has a circuit board 10 with a suitable length and a suitable width. The circuit board 10 had better do not have any metallic portion in the back side thereof in order to get the function of receiving and emitting signals in all the directions; a spiral antenna element and a ground plane 30 are provided on the surface thereof.

The spiral antenna element in the preferred embodiment has a ¼λ (wavelength) microstrip line 20 rolled on the surface of the circuit board 10 in the shape of a rectangular spiral, the end of the rectangular spiral microstrip line 20 is connected via a vertical section 24 to another microstrip line 60 which acts as an open-stub for adjustment of bandwidth and impedance matching.

A junction 26 of the rectangular spiral microstrip line 20 with the microstrip line 60 of the open-stub acts as a signal feeder point.

Figure 2:
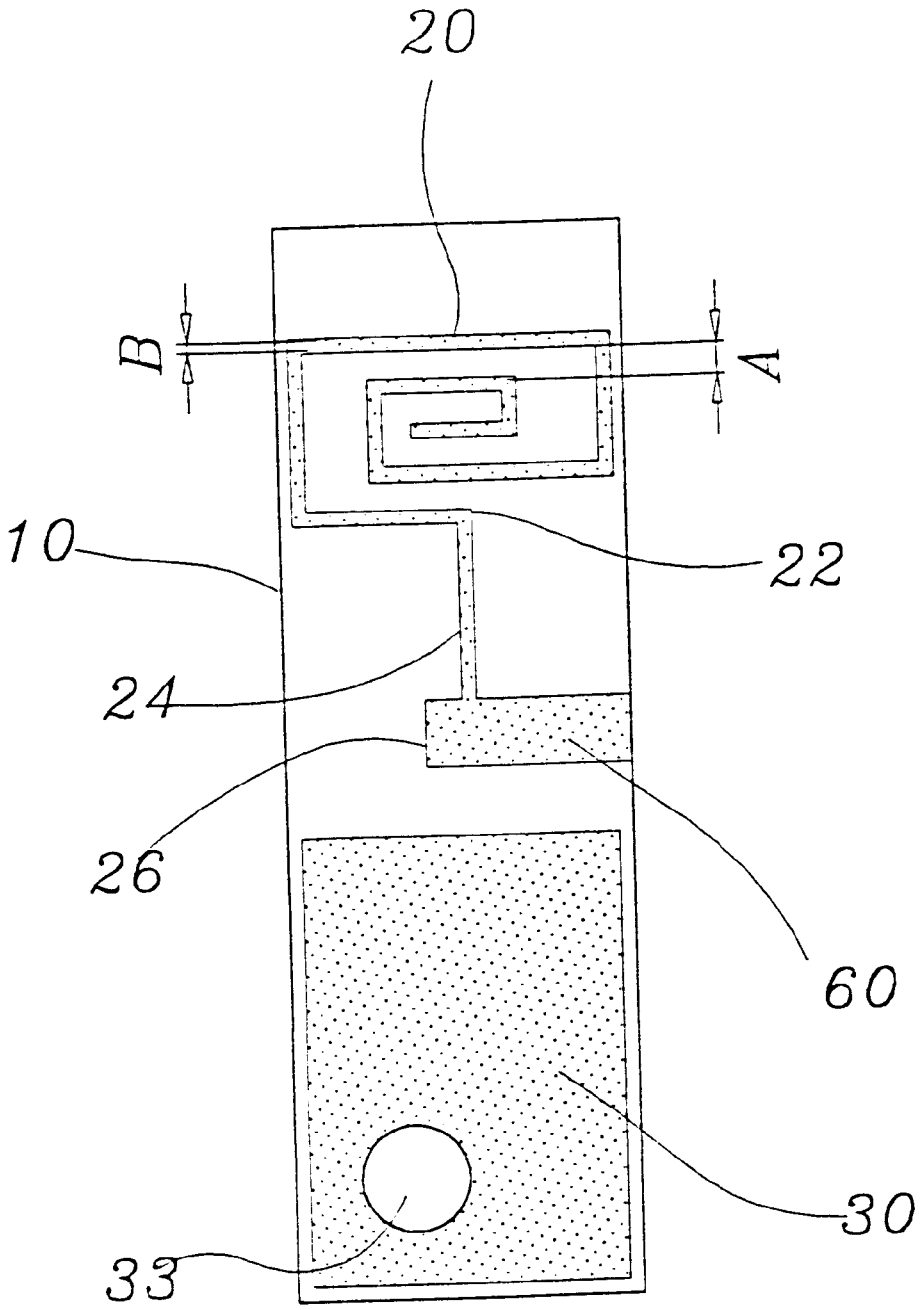
FIG. 2 is a plane view of FIG. 1.

As shown in FIG. 2, the distance "A" of the rectangular ¼λ microstrip line 20 when being rolled had better is twice the width "B" of the rectangular microstrip line 20 in order to prevent signal disturbance.

The above mentioned ground plane 30 is provided near and around the signal feeder point, or is located by the junction 26 of the rectangular spiral microstrip line 20 with the open-stub but does not connect with the signal feeder point at the junction 26. The ground plane 30 can be punched to form a hole 33 to get the desired harmonic oscillation frequency shifting. The harmonic oscillation frequency shifting created by punching on the ground plane 30 of such an antenna was stated in the "IEEE Transactions of antenna and propagation, Vol. 42, No. 9, September 1994".

Figure 3:
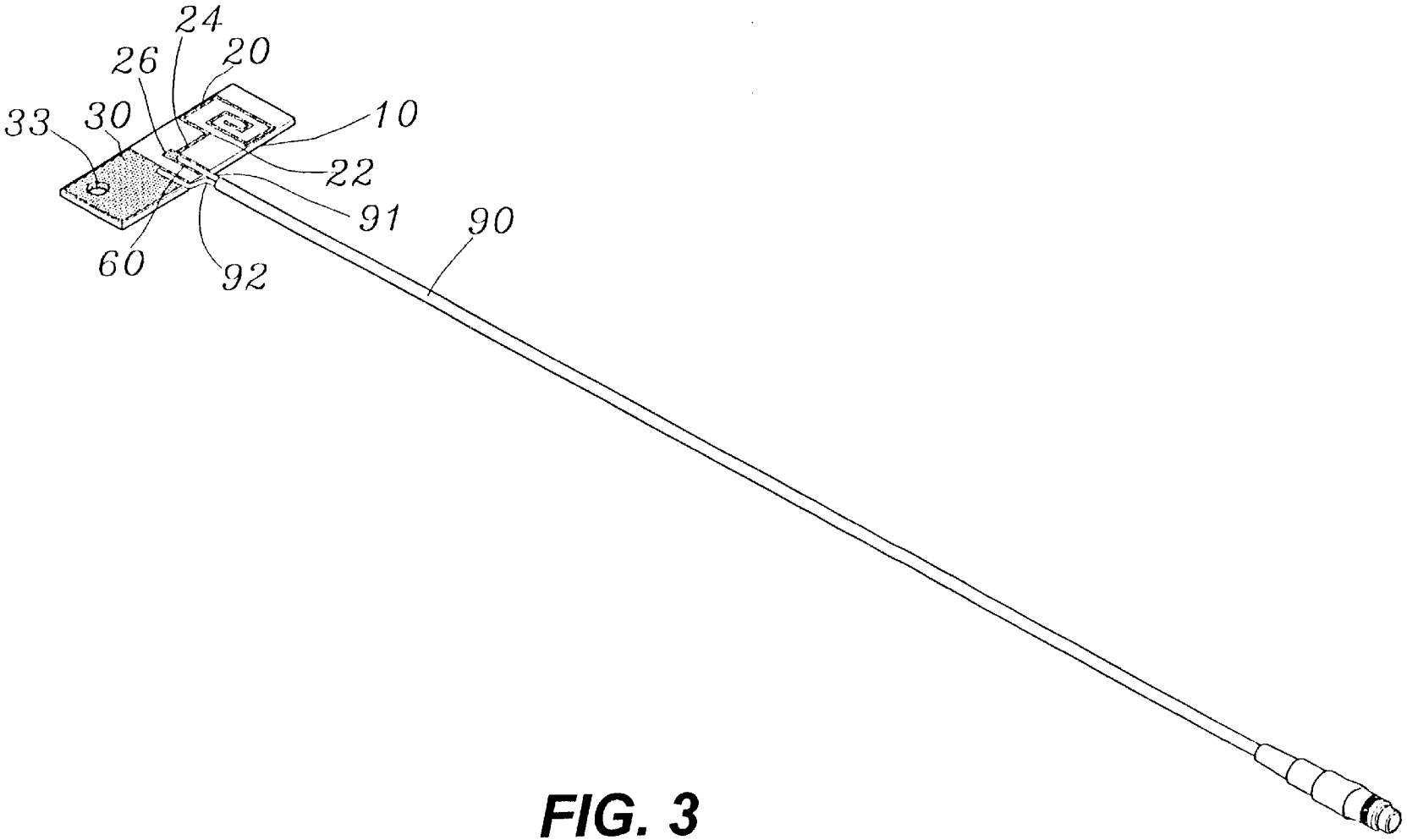
FIG. 3 is a schematic view showing wire connection of FIG. 1.

As shown in FIG. 3, such an antenna of the present invention can has the conductors 91, 92 of a connecting line 90 of a connecting device connected with the microstrip line 60 which acts as an open-stub and the ground plane 30 for assembling in the interior of a communication instrument.

The improved structure of the present invention can get the function of receiving and emitting signals in all the directions; size of the microstrip antenna on the electric circuit board can be effectively reduced to render the antenna to be a miniature one.

The preferred embodiment disclosed above is only for illustrating the present invention. It will be apparent to those skilled in this art that various modifications or changes can be made to the elements of the present invention without departing from the spirit and characteristic of this invention. Accordingly, all such modifications and changes also fall within the scope of the appended claims and are intended to form part of this invention.

What is claimed is:

1. A miniature microstrip antenna having a circuit board with a suitable length and a suitable width, said circuit board does not have any metallic portion in the back side thereof, a ¼λ microstrip line is rolled on the surface of said circuit board in the shape of a rectangular spiral, the end of said rectangular spiral microstrip line is connected via a vertical section to another 1/20λ microstrip line which acts as an open-stub, a junction of said rectangular spiral microstrip line with said open-stub acts as a signal feeder point; a ground plane is provided near said signal feeder point but does not connect with said signal feeder point, said ground plane is punched to form a hole to get a desired harmonic oscillation frequency shifting.

2. A miniature microstrip antenna as defined in claim 1, wherein, distance between every two revolutions of said rectangular ¼λ microstrip line is twice the width of said rectangular microstrip line.

* * * * *